US007373743B1

(12) United States Patent
Hess

(10) Patent No.: US 7,373,743 B1
(45) Date of Patent: May 20, 2008

(54) FLAME SIMULATING ASSEMBLY

(75) Inventor: Kristoffer Hess, Cambridge (CA)

(73) Assignee: Dimplex North America Limited, Cambridge, ON (CA)

( * ) Notice: Subject to any disclaimer, the term of this patent is extended or adjusted under 35 U.S.C. 154(b) by 0 days.

(21) Appl. No.: 11/686,007

(22) Filed: Mar. 14, 2007

(51) Int. Cl.
*G09F 19/12* (2006.01)

(52) U.S. Cl. ..... 40/428; 472/65; 392/348; 362/253; 362/806; 362/96

(58) Field of Classification Search ..... 40/428, 40/431; 219/220; 126/500; 362/253, 806, 362/96; 392/348; 431/125; 472/65
See application file for complete search history.

(56) References Cited

U.S. PATENT DOCUMENTS

| | | | | |
|---|---|---|---|---|
| 566,564 | A | 8/1896 | Dewey | |
| 1,531,171 | A | 3/1925 | Berry et al. | |
| 1,586,597 | A | 6/1926 | Berry et al. | |
| 1,590,083 | A | 6/1926 | Collins | |
| 1,692,021 | A | 11/1928 | Auer | |
| 1,703,761 | A | 2/1929 | Berry | |
| 1,719,622 | A * | 7/1929 | Price | 40/428 |
| 1,768,284 | A | 6/1930 | Berry | |
| 1,827,941 | A | 10/1931 | Gross | |
| 1,839,165 | A | 12/1931 | Roseby | |
| 1,867,740 | A | 7/1932 | Guy | |
| 1,901,294 | A | 3/1933 | Gritt et al. | |
| 1,992,540 | A | 2/1935 | Newton | |
| 2,285,535 | A | 6/1942 | Schlett | |
| 2,708,114 | A | 5/1955 | Hancock | |
| 2,963,807 | A | 12/1960 | Relph et al. | |
| 2,984,032 | A | 5/1961 | Cornell | |
| 3,395,475 | A | 8/1968 | Moss | |
| 3,395,476 | A | 8/1968 | Moss et al. | |
| 3,445,948 | A | 5/1969 | Moss et al. | |
| 3,499,239 | A | 3/1970 | Mungo | |
| 3,526,984 | A * | 9/1970 | Nielsen | 40/428 |
| 3,603,013 | A | 9/1971 | Reed et al. | |
| 3,699,697 | A | 10/1972 | Painton | |
| 3,742,189 | A | 6/1973 | Conroy et al. | |

(Continued)

FOREIGN PATENT DOCUMENTS

| | | |
|---|---|---|
| EP | 0348137 | 12/1989 |

(Continued)

OTHER PUBLICATIONS

Electric Power Research Institute, Residential Electric Fireplaces—Review of the State of the Art, Final Report, May 1997.

*Primary Examiner*—Lesley D. Morris
*Assistant Examiner*—Shin Kim

(57) ABSTRACT

A flame simulating assembly for providing an image of flames and simulating one or more actual fuel elements in a fire. The flame simulating assembly includes one or more light sources, a screen adapted for transmission of the image of flames therethrough, and a simulated fuel bed. The simulated fuel bed includes a simulated ember bed and one or more simulated fuel elements positioned on an upper surface of the simulated ember bed. Each simulated fuel element includes a base surface with a light-transmitting portion and an exposed surface which is at least partially viewable. The base surface is positioned proximal to the upper surface of the simulated ember bed. The exposed surface includes one or more uncovered portions through which light from the light source is transmittable.

26 Claims, 4 Drawing Sheets

U.S. PATENT DOCUMENTS

| | | | | |
|---|---|---|---|---|
| 3,978,598 | A | 9/1976 | Rose et al. | |
| 4,026,544 | A | 5/1977 | Plambeck et al. | |
| 4,726,351 | A | 2/1988 | Whittaker et al. | |
| 4,890,600 | A | 1/1990 | Meyers | |
| 4,965,707 | A | 10/1990 | Butterfield | |
| 5,195,820 | A | 3/1993 | Rehberg | |
| 5,642,580 | A | 7/1997 | Hess et al. | |
| 5,826,357 | A | 10/1998 | Hechler | |
| 6,047,489 | A | 4/2000 | Hess et al. | |
| 6,050,011 | A | 4/2000 | Hess et al. | |
| 6,162,047 | A | 12/2000 | Hess | |
| 6,269,567 | B1 | 8/2001 | MacPherson et al. | |
| 6,302,555 | B1 | 10/2001 | Bristow | |
| 6,363,636 | B1 | 4/2002 | Hess et al. | |
| 6,385,881 | B1 * | 5/2002 | Hess | 40/428 |
| 6,393,207 | B1 * | 5/2002 | Martin et al. | 392/348 |
| 6,564,485 | B1 | 5/2003 | Hess | |
| 6,615,519 | B2 | 9/2003 | Hess | |
| 6,691,440 | B1 | 2/2004 | Petz et al. | |
| 6,718,665 | B2 | 4/2004 | Hess et al. | |
| 6,757,487 | B2 | 6/2004 | Martin et al. | |
| 6,799,727 | B2 | 10/2004 | Webster et al. | |
| 6,880,275 | B2 | 4/2005 | Mix et al. | |
| 6,919,884 | B2 | 7/2005 | Mix et al. | |
| 6,944,982 | B2 | 9/2005 | Schroeter et al. | |
| 6,968,123 | B2 | 11/2005 | Ravnbo-West et al. | |
| 7,111,421 | B2 | 9/2006 | Corry et al. | |
| 7,134,229 | B2 | 11/2006 | Hess et al. | |
| 7,162,820 | B2 | 1/2007 | Jess et al. | |
| 7,194,830 | B2 | 3/2007 | Hess | |
| 2002/0166554 | A1 | 11/2002 | Berg | |
| 2003/0041491 | A1 | 3/2003 | Mix | |
| 2003/0046837 | A1 | 3/2003 | Hess | |
| 2003/0049024 | A1 * | 3/2003 | Chen | 392/348 |
| 2003/0156828 | A1 | 8/2003 | Jamieson et al. | |
| 2004/0114351 | A1 | 6/2004 | Stokes et al. | |
| 2004/0181983 | A1 | 9/2004 | Hess et al. | |
| 2004/0255931 | A1 | 12/2004 | Bachinski et al. | |
| 2004/0264949 | A1 | 12/2004 | Deng | |
| 2005/0063685 | A1 | 3/2005 | Bristow | |
| 2005/0097792 | A1 | 5/2005 | Naden | |
| 2005/0155262 | A1 | 7/2005 | Mix et al. | |
| 2005/0252051 | A1 | 11/2005 | Chen | |
| 2006/0026894 | A1 | 2/2006 | Hess et al. | |
| 2006/0101681 | A1 | 5/2006 | Hess et al. | |
| 2006/0153547 | A1 | 7/2006 | O'Neill | |
| 2006/0162198 | A1 | 7/2006 | Hess et al. | |
| 2006/0185664 | A1 | 8/2006 | Butler et al. | |
| 2006/0188831 | A1 | 8/2006 | Hess et al. | |
| 2006/0242870 | A1 | 11/2006 | Atemboski et al. | |
| 2007/0094903 | A1 | 5/2007 | Hess et al. | |
| 2007/0107280 | A1 | 5/2007 | Stinson et al. | |

FOREIGN PATENT DOCUMENTS

| | | |
|---|---|---|
| EP | 0611921 | 8/1994 |
| EP | 1020685 | 7/2000 |
| EP | 1239223 | 9/2002 |
| EP | 1271060 | 1/2003 |
| GB | 186234 | 9/1922 |
| GB | 210968 | 2/1924 |
| GB | 249321 | 3/1926 |
| GB | 272362 | 6/1927 |
| GB | 272836 | 6/1927 |
| GB | 274615 | 7/1927 |
| GB | 322688 | 12/1929 |
| GB | 370618 | 4/1932 |
| GB | 371732 | 4/1932 |
| GB | 410123 | 5/1934 |
| GB | 414280 | 8/1934 |
| GB | 416358 | 9/1934 |
| GB | 426887 | 4/1935 |
| GB | 631594 | 11/1949 |
| GB | 928851 | 6/1963 |
| GB | 957591 | 5/1964 |
| GB | 968568 | 9/1964 |
| GB | 975009 | 11/1964 |
| GB | 978364 | 12/1964 |
| GB | 978365 | 12/1964 |
| GB | 1024047 | 3/1966 |
| GB | 1088577 | 10/1967 |
| GB | 1097812 | 1/1968 |
| GB | 1113209 | 5/1968 |
| GB | 1164143 | 9/1969 |
| GB | 1186655 | 4/1970 |
| GB | 1212399 | 11/1970 |
| GB | 1266131 | 3/1972 |
| GB | 1272644 | 5/1972 |
| GB | 1407926 | 10/1975 |
| GB | 1443772 | 7/1976 |
| GB | 1457540 | 12/1976 |
| GB | 2137336 | 10/1984 |
| GB | 2149090 | 6/1985 |
| GB | 2151772 | 7/1985 |
| GB | 2180927 | 4/1987 |
| GB | 2198835 | 6/1988 |
| GB | 2210969 | 6/1989 |
| GB | 2222000 | 2/1990 |
| GB | 2230335 | 10/1990 |
| GB | 2240171 | 7/1991 |
| GB | 2241575 | 9/1991 |
| GB | 2242737 | 9/1991 |
| GB | 2251935 | 7/1992 |
| GB | 2256040 | 11/1992 |
| GB | 2264555 | 9/1993 |
| GB | 2267563 | 12/1993 |
| GB | 2275105 | 8/1994 |
| GB | 2276444 | 9/1994 |
| GB | 2288052 | 10/1995 |
| GB | 2290374 | 12/1995 |
| GB | 2290865 | 1/1996 |
| GB | 2298073 | 8/1996 |
| GB | 2302172 | 1/1997 |
| GB | 2302730 | 1/1997 |
| GB | 2307132 | 5/1997 |
| GB | 2315543 | 2/1998 |
| GB | 2321700 | 8/1998 |
| GB | 2325733 | 12/1998 |
| GB | 2350182 | 11/2000 |
| GB | 2372807 | 9/2002 |
| GB | 2377752 | 1/2003 |
| GB | 2379009 | 2/2003 |
| GB | 2404730 | 2/2005 |
| GB | 2408322 | 5/2005 |
| GB | 2408794 | 6/2005 |
| GB | 2409323 | 6/2005 |
| GB | 2418984 | 4/2006 |
| GB | 2427021 | 12/2006 |
| WO | WO 97/41393 | 11/1997 |
| WO | WO 99/45326 | 9/1999 |
| WO | WO 01/57447 | 8/2001 |
| WO | WO 2004/027321 | 4/2004 |
| WO | WO 2004/109189 | 12/2004 |
| WO | WO 2005/028962 | 3/2005 |
| WO | WO 2005/078350 | 8/2005 |
| WO | WO 2006/027272 | 3/2006 |
| WO | WO 2006/027273 | 3/2006 |
| WO | WO 2006/040167 | 4/2006 |

* cited by examiner

FLAME SIMULATING ASSEMBLY

FIELD OF THE INVENTION

The present invention relates to flame simulating assemblies.

BACKGROUND OF THE INVENTION

Various types of flame simulating assemblies, such as electric fireplaces, are known. Many of the prior art flame simulating assemblies include one or more components intended to resemble actual fuel in a real fire. Typically, the fuel which is simulated is wood (i.e., logs), or coal.

For example, U.S. Pat. No. 566,564 (Dewey) discloses an electric heating apparatus with a cover (B') which "is made . . . of a transparent or semitransparent material" (p. 1, lines 50-52). The cover is "fashioned or colored" so that it resembles coal or wood "in a state of combustion when light is radiated through it" (p. 1, lines 53-57).

However, the use of a partially translucent shell such as the cover disclosed in Dewey to imitate burning solid combustible fuel has some disadvantages. In particular, a portion of the shell typically is formed to simulate the fuel (e.g., logs), and another portion of the shell simulates an actual ember bed (i.e., embers and ashes) which results from combustion of the fuel. For instance, where the combustible fuel to be simulated is wood in the form of logs, the logs are simulated in the shell by raised parts which are integral to the shell, rather than pieces which are physically separate from the ember bed. Because it is evident from even a cursory observation of this type of prior art imitative fuel bed that the raised parts (i.e., simulated logs) are formed integrally with the simulated ember bed part of the shell, this type of imitative fuel bed tends to detract from the simulation effect sought.

In some flame simulating assemblies of the prior art, the simulated fuel components are intended to represent actual glowing coals, i.e., partially combusted (and combusting) coals in a fire. For example, some prior art imitative coal pieces are separate elements, shaped and sized to resemble actual pieces of coal, which are made of a transparent or translucent material (e.g., glass) through which light is transmitted, in an attempt to simulate the glowing effect sometimes provided by actual pieces of coal in a real fire. Examples of such simulated fuel components are found in GB 249,321 (White), U.S. Pat. No. 1,692,021 (Auer), and U.S. Pat. No. 4,965,707 (Butterfield). In each of these prior art fuel beds, however, the pieces of glass or other light-transmitting material intended to simulate coal are shaped and colored internally (i.e., they are made of a transparent or translucent material colored appropriately) in order to achieve such an effect. However, the known imitative coal pieces have some disadvantages.

In particular, each such piece generally has only one color, unlike actual pieces of coal in a real fire. In contrast, actual pieces of coal in a fire tend to have dark portions which are generally black or dark gray, and glowing portions which have brighter colors, such as red, orange, yellow, and combinations thereof. The dark portions may be largely matte, or partly matte with some small glossy parts irregularly distributed therethrough. Also, the part of the surface of each prior art imitative coal piece which is not glowing tends to be much more glossy than the surfaces of coal pieces in a real fire, so that the simulation provided is thereby undermined.

There is therefore a need for an improved flame simulating assembly to overcome or mitigate at least one of the disadvantages of the prior art.

SUMMARY OF THE INVENTION

In its broad aspect, the invention provides a flame simulating assembly for providing one or more images of flames and simulating one or more actual fuel elements in a fire. Each such actual fuel element has one or more glowing portions and one or more dark portions. The flame simulating assembly includes one or more light sources, a screen, and a simulated fuel bed. The screen is positioned in a first path of light from the light source, and the screen is adapted for transmission of the image of flames therethrough. The simulated fuel bed is positioned at least partially in front of a front surface of the screen. The simulated fuel bed includes a simulated ember bed and one or more simulated fuel elements positioned on an upper surface of the simulated ember bed. The simulated ember bed is positioned in a second path of light from the light source and adapted for transmission of the light therethrough. Each simulated fuel element includes a base surface positioned proximal to the upper surface and including one or more light-transmitting portions through which light from the light source is transmittable. Each simulated fuel element also includes an exposed surface which is at least partially viewable and which includes one or more uncovered portions through which light from the light source is transmittable. Light from the light source is transmittable through the simulated ember bed and through the uncovered portion(s) to simulate the glowing portion(s) of the actual fuel element.

In another aspect, the exposed surface of the simulated fuel element includes one or more covered portions for simulating the dark portions of the actual fuel element.

In another of its aspects, the invention provides a simulated fuel element for simulating an actual fuel element in a fire having one or more glowing portions and one or more dark portions. The simulated fuel element includes a light-transmitting body having a base surface which is positionable in a predetermined position in which the base surface faces downwardly. The body additionally includes an exposed surface which is at least partially viewable when the body is positioned in the predetermined position. The base surface also includes one or more light-transmitting portions through which light is transmittable into the body. The exposed surface also includes one or more uncovered portions through which light transmitted through the body is transmittable to simulate the glowing portion of the actual fuel element.

In yet another aspect, the exposed surface additionally includes one or more covered portions for simulating the dark portion of the actual fuel element.

In another of its aspects, the invention provides a method of forming a simulated fuel element for simulating an actual fuel element in a fire. The method includes, first, the step of providing a light-transmitting body with a base surface on which the body is positionable when the body is disposed in a predetermined position, and an untreated surface which is substantially exposed when the body is in the predetermined position. Next, the untreated surface is at least partially covered with a treatment material, to provide a preliminary exposed surface. Finally, one or more uncovered portions of the preliminary exposed surface are formed, to permit light to be transmitted through the uncovered portion(s) so that the uncovered portion(s) simulate the glowing portion(s) of the actual fuel element.

In yet another aspect, the step of forming the uncovered portions at least partially defines one or more covered portions for simulating the dark portion(s) of the actual fuel element.

In yet another of its aspects, the invention provides another method of forming a simulated fuel element for simulating an actual fuel element in a fire. The method includes, first, the step of providing a light-transmitting body with a base surface on which the body is positionable when the body is disposed in a predetermined position. The body also includes an untreated surface which is substantially exposed when the body is in the predetermined position. Next, one or more light-transmitting portions of the base surface are masked to substantially prevent a treatment material from contacting the light-transmitting portion. In the next step, the untreated surface is at least partially covered with the treatment material, to provide a preliminary exposed surface. Finally, one or more uncovered portions of the preliminary exposed surface are formed to permit light to be transmitted through the uncovered portion(s) so that the uncovered portion(s) simulates the glowing portion(s) of the actual fuel element.

In another of its aspects, the invention provides a simulated fuel bed for simulating an actual fuel bed including one or more actual fuel elements having one or more glowing portions and one or more dark portions. The simulated fuel bed includes one or more light sources, a simulated ember bed, and one or more simulated fuel elements. The simulated ember bed is positioned in a path of light from the light source and is adapted for transmission of light from the light source therethrough. The simulated fuel element is positioned on an upper surface of the simulated fuel bed, and includes a base surface which is positioned proximal to the upper surface. The base surface includes one or more light-transmitting portions through which the light from the light source is transmittable. The simulated fuel element also includes an exposed surface which is at least partially viewable and which includes one or more uncovered portions through which light from the light source is transmittable. Accordingly, light from the light source is transmittable through the simulated ember bed and through the uncovered portion(s) to simulate the glowing portion(s) of the actual fuel element.

In yet another aspect, each simulated fuel element's exposed surface includes one or more covered portions (which are covered with the treatment material) for simulating the dark portion(s) of the actual fuel element.

BRIEF DESCRIPTION OF THE DRAWINGS

The invention will be better understood with reference to the drawings, in which.

DETAILED DESCRIPTION

Figure 1:
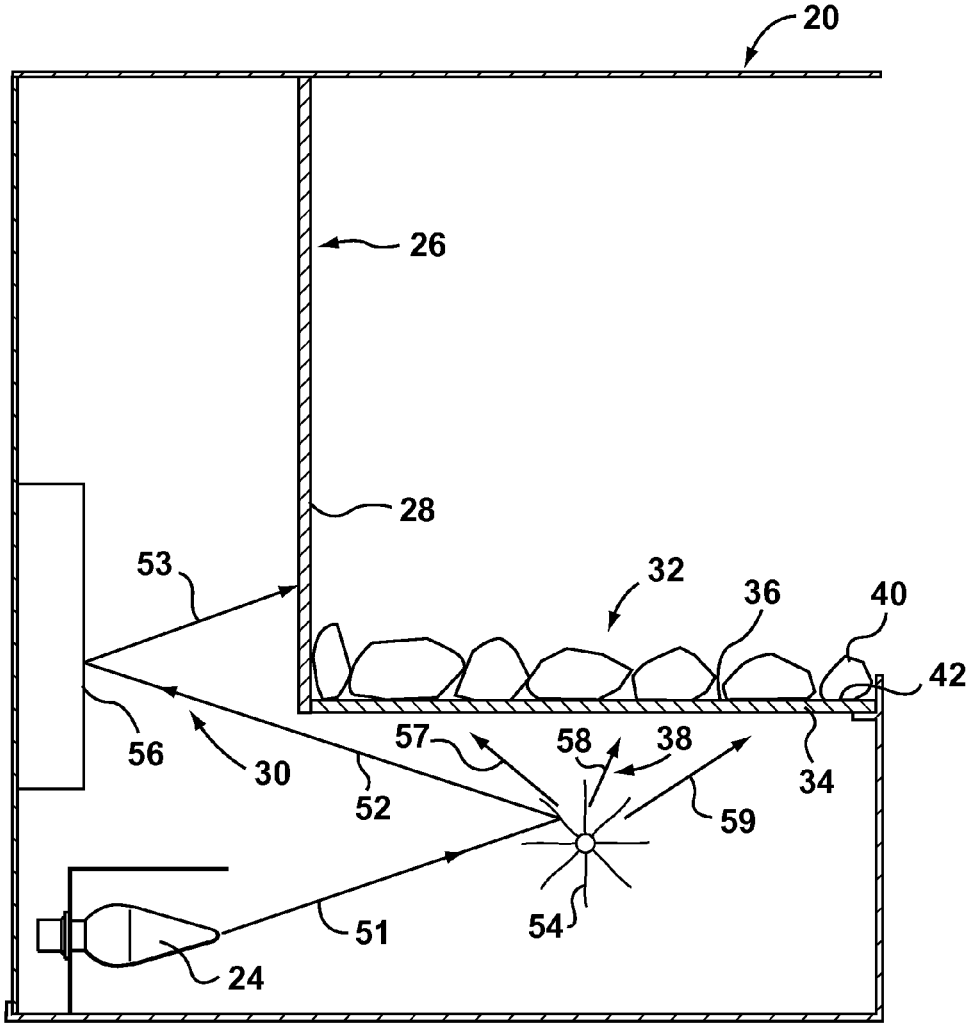
FIG. 1 is a cross-section of an embodiment of the flame simulating assembly of the invention.
Figure 2:
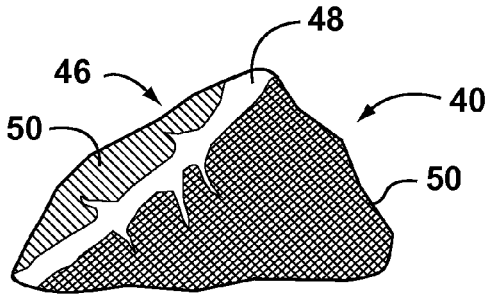
FIG. 2 is an isometric view of an embodiment of a simulated fuel element of the invention illustrating a portion of an exposed surface thereof, drawn at a larger scale.
Figure 3:
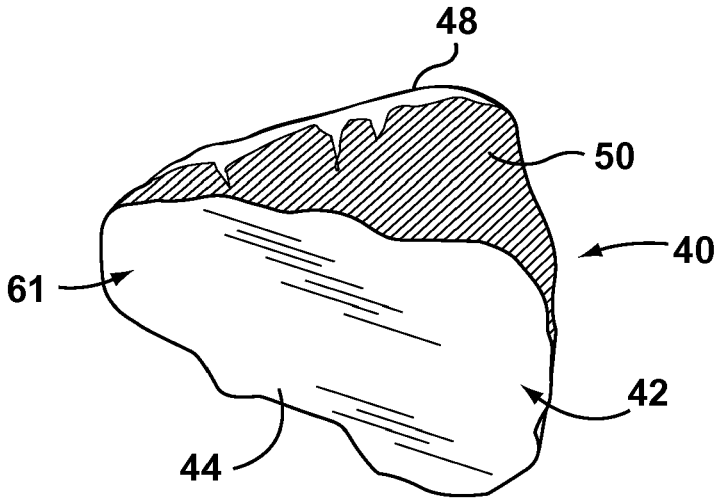
FIG. 3 is an isometric view of the simulated fuel element of FIG. 2 illustrating a base surface thereof.

Reference is first made to FIGS. 1-4 to describe an embodiment of a flame simulating assembly in accordance with the invention indicated generally by the numeral 20. The flame simulating assembly 20 is for providing one or more images of flames 22 and simulating an actual fuel element in a fire (not shown) having one or more glowing portions and one or more dark portions. The flame simulating assembly 20 includes one or more light sources 24 and a screen 26 having a front surface 28. The screen 26 is positioned in a first path of light 30 (FIG. 1) from the light source 24. Preferably, the screen 26 is adapted for transmission of the image of flames 22 therethrough, as will be described. The flame simulating assembly 20 also preferably includes a simulated fuel bed 32 positioned at least partially in front of the front surface 28. It is preferred that the simulated fuel bed 32 includes a simulated ember bed 34 with an upper surface 36 (FIG. 1). Preferably, the simulated ember bed 32 is positioned in a second path of light 38 from the light source 24 and adapted for transmission of light therethrough, as will also be described. In addition, the simulated fuel bed 32 preferably includes one or more simulated fuel elements 40 positioned on the upper surface 36 of the simulated ember bed 34. Each simulated fuel element 40 preferably includes, first, a base surface 42 which is positioned proximal to the upper surface 36, in a predetermined position. Also, the base surface 42 preferably includes one or more light-transmitting portions 44 through which light from the light source 24 is transmittable. In addition, and as can be seen in FIGS. 2 and 3, it is also preferred that each simulated fuel element 40 includes an exposed surface 46 which is at least partially viewable. The exposed surface 46 includes one or more uncovered portions 48 (FIGS. 2, 3) through which light from the light source 24 is transmittable, so that light from the light source 24 is transmittable through the simulated ember bed 34 and through the prepared portion 48 to simulate the glowing portion of the fuel element.

As shown in FIG. 1, it is preferred that the base surface 42 engages the upper surface 36 of the simulated ember bed 32. However, it will be understood that it is not necessary that the base surface 42 contacts the upper surface 36. The base surface 42 preferably is positioned at least proximal to the upper surface 36. The upper surface 36 of the simulated ember bed 32 preferably is substantially planar, as shown in FIG. 1. However, those skilled in the art would understand that the upper surface of the simulated ember bed may have various configurations.

Figure 4:
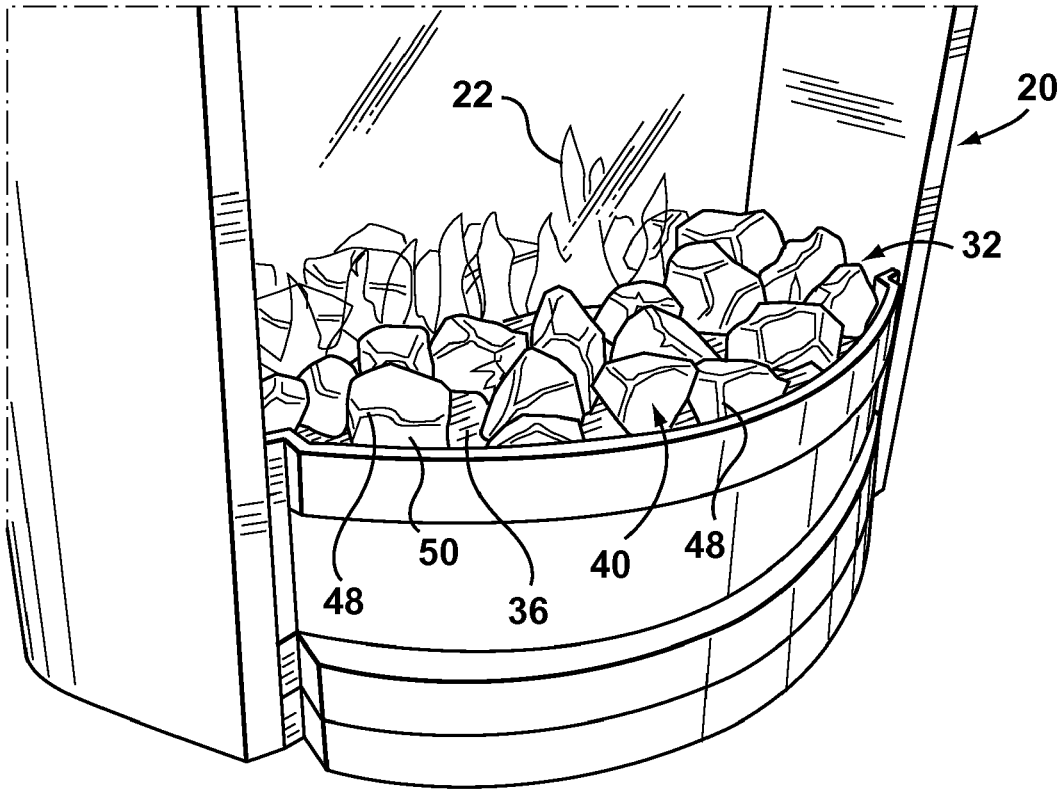
FIG. 4 is an isometric view of the flame simulating assembly of FIG. 1, drawn at a smaller scale.

Preferably, the simulated fuel elements 40 are selectively positionable relative to each other on the upper surface 36, in a variety of positions. For example, in one embodiment, the simulated fuel elements 40 preferably are positioned loosely on a substantially planar upper surface 36, and this permits a user (not shown) to arrange the simulated fuel elements 40 according to the user's preferences from time to time. As shown in FIG. 4, the user may position the simulated fuel elements 40 in an arrangement in which one or more portions of the upper surface 36 are exposed. Preferably, the simulated ember bed 32 is colored a suitable color, so that the exposed portions enhance the simulation effect. This embodiment also has the advantage that it facilitates cleaning (e.g., dusting) of the simulated fuel bed.

The simulated ember bed 32 preferably is at least partially translucent and has any suitable coloring. Depending on the fuel which the simulated fuel bed is intended to resemble, various colors (and/or combinations thereof, as the case may be) may be used. The light source may provide light which is colored, if desired. If the light provided by the light source is not white light, then the coloring of the light preferably is taken into account in determining the coloring of the simulated ember bed. However, it is preferred that the light source provides white light, because sources of white light are more common. It is also preferred that the simulated ember bed is colored with suitable shades of the colors yellow, red, and orange, and/or combinations thereof. The term reddish, as used herein, refers to any suitable combination of colors used in a simulated ember bed to simulate burning embers. Those skilled in the art would be aware of the colors which are suitable. Preferably, the simulated ember bed is reddish in color.

As will be described, each simulated fuel element includes a body which preferably is adapted for transmission of light therethrough. It is preferred that the body is translucent or transparent. The body preferably is colored so that the coloring thereof enhances the overall simulation effect provided by a simulated fuel bed in which the simulated fuel element is located. For instance, a body which is colored reddish provides a simulated glowing effect which is generally an effective simulation of an actual fuel bed.

As shown in FIGS. 2 and 3, it is preferred that the exposed surface 46 also includes one or more covered portions 50 for simulating the dark portions of the actual fuel elements in a real fire. As is known, the dark portions of an actual fuel element may be largely matte, or partly matte with some glossy parts irregularly distributed therethrough, or largely glossy. Also, the color of the dark portions of the actual fuel element may vary from a relatively uniform black or gray to a mixture thereof, or a mixture of black, gray and brown.

The covered portions 50 preferably are covered with the treatment material, which preferably is selected so that the covered portions resemble the dark portions of an actual piece of coal. In practice, this is achieved primarily by applying a coat of a suitable paint to the exposed surface, as will be described. It will be understood by those skilled in the art that any suitable paint could be used as the treatment material. Accordingly, it is preferred that the paint which is selected for use as the treatment material provides a realistic finish and coloring. For instance, in one embodiment, the treatment material is a dark paint which provides a matte finish. In another embodiment, the treatment material preferably is a dark enamel paint. Alternatively, in another embodiment, the treatment material is a dark polyester-based paint. In particular, it has been determined that paint no. 12848 (hot paint—black) provided by ICI Canada is a suitable treatment material.

Where the body is colored reddish, the body's reddish color also tends to infuse the covered portions 50 with such reddish color when light is transmitted through the body. This tends to enhance the overall simulation effect provided by the simulated fuel bed because it is a somewhat more realistic representation of the dark portion(s) of an actual fuel element in a fire.

Preferably, the flame simulating assembly 20 includes one or more light sources 24, positioned generally as shown in FIG. 1. As described above, the screen 26 is positioned in the first path of light 30 (schematically represented by arrows 51, 52, and 53 in FIG. 1) from the light source 24. The light from the light source 24 which is in the first path of light 30 is reflected by a flicker element 54 and a flame effect element 56 to provide the image of flames. The arrangement of the light source, the flicker element, the flame effect element, and the screen is known, and is generally as disclosed in PCT application no. PCT/CA97/00299 (published as WO 97/41393), the entire specification of which is hereby incorporated herein by reference. The flame effect element 56 is similar to the flame effect element 58", which was disclosed in FIGS. 15-17 in WO 97/41393, and on page 19, at lines 15-31 thereof.

The second path of light 38 is from the light source 24 to the simulated ember bed 34. The second path of light 38 is schematically illustrated by arrows 51, 57, 58, and 59 in FIG. 1.

It will be understood by those skilled in the art that different arrangements of light sources are feasible. For instance, the flame simulating assembly of the invention may, alternatively, include separate light sources for the image of flames and the simulated fuel bed respectively. However, the use of one or more light sources positioned as shown in FIG. 1 is preferred because it is relatively economical and tends to require less space.

Figure 5:
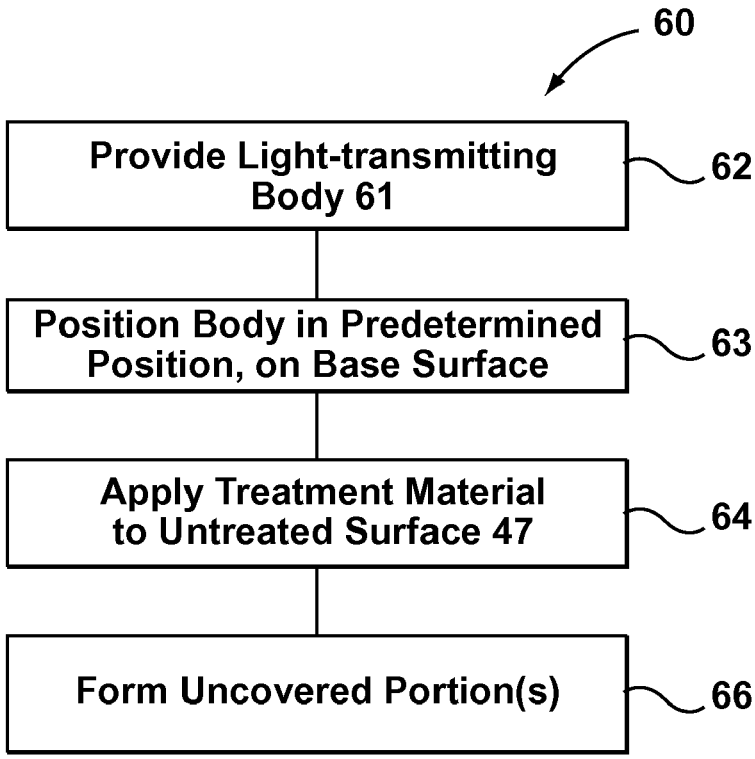
FIG. 5 is a schematic illustration of an embodiment of a process of the invention for forming the simulated fuel element of FIG. 2.
Figure 6:
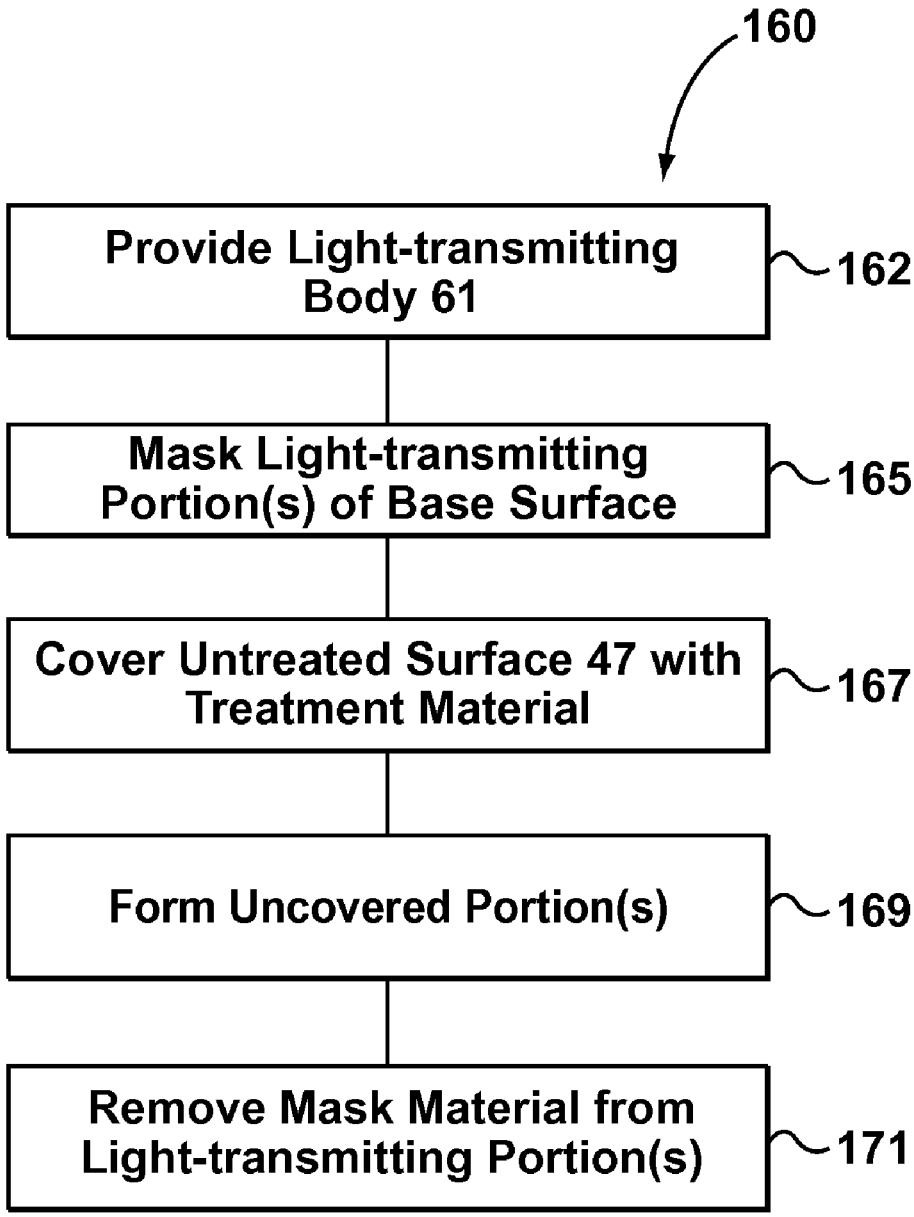
FIG. 6 is a schematic illustration of an alternative embodiment of the process of the invention.

Additional embodiments of the invention are shown in FIGS. 5 and 6. In FIGS. 5 and 6, elements are numbered so as to correspond to like elements shown in FIGS. 1-4.

One embodiment of a method 60 of the invention of forming the simulated fuel element 40 is disclosed in FIG. 5. The method 60 preferably begins with a first step 62 of providing a light-transmitting body 61 with the base surface 42 on which the body 61 is positionable, when the body 61 is disposed in a predetermined position. In the next step 63, the body 61 is positioned in the predetermined position (i.e., base surface down). The body 61 also includes an untreated surface 47, which is substantially exposed when the body 61 is in the predetermined position. In the next step 64, the untreated surface 47 is at least partially covered with the treatment material (e.g., paint), to provide a preliminary exposed surface 46. Finally, the method 60 includes a step 66 of forming one or more uncovered portions 48 of the exposed surface 46, so as to permit light to be transmitted through the uncovered portion(s) 48. As will be described, the uncovered portions may be formed in various ways. It is preferred that the uncovered portions are formed by at least partial removal of the treatment material from the uncovered portions. Preferably, the treatment material is removed from the uncovered portion(s) by abrasion, to provide the exposed surface. The removal of the treatment material from the uncovered portions defines the uncovered portions, and also defines the covered portions of the exposed surface.

In this method, the last step also at least partially defines one or more covered portions (i.e., covered with the treatment material) for simulating the dark portion(s) of the actual fuel element.

The uncovered portions may be formed in various ways. As indicated above, in one embodiment, it is preferred that the untreated surface is covered with the treatment material (preferably, a suitable paint), which is allowed to dry. Next, the treatment material is removed from the uncovered portions by abrasion, for example, via manually-applied sandpaper. However, in an alternative embodiment of the method of the invention, the treatment material is not allowed to dry, and instead, the treatment material (i.e., while still at least partially liquid) is wiped off the uncovered portions, for example, using a manually-applied cloth. In yet another embodiment of the method of the invention, a mask material is used to mask the uncovered portions, i.e., to substantially prevent treatment material from contacting the uncovered portions. After the treatment material is applied, the mask material is removed, to provide uncovered portions which are not covered by the treatment material.

FIG. 6 discloses another embodiment, being an alternative method 160 of the invention of forming a simulated fuel element. The method 160 includes, in a first step 162, providing the light-transmitting body 61 with the base surface 42 on which the body 61 is positionable, when the body 61 is disposed in a predetermined position. The base surface 42 includes one or more light-transmitting portions 44. Also, the body 61 includes an untreated surface 47 which is substantially exposed when the body 61 is in the predetermined position. In a next step 165, the light-transmitting portion(s) 44 is masked to substantially prevent the treatment material from contacting the light-transmitting portion. The masking preferably is done by covering the light-transmitting portion on the base surface with a mask material. In a next step 167, the untreated surface 47 is at least partially covered with the treatment material (e.g., paint), to provide a preliminary exposed surface 46. In another step 169, the uncovered portion 48 of the untreated surface 47 is formed, to permit the uncovered portion 48 to transmit light therethrough. The method 160 of the invention also includes, in one embodiment, a step 171 of removing the mask material from the light-transmitting portion, to uncover the light-transmitting portion. The order of the final two steps of this process may be changed. It will be understood that, if desired, treatment material could be removed from the uncovered portions prior to removal of the mask material.

It is preferred that the uncovered portions are formed by at least partial removal of the treatment material from the uncovered portions. In this method, the step of removing some of the treatment material to define the uncovered portion(s) also at least partially defines one or more covered portions (i.e., covered with the treatment material) for simulating the dark portion(s) of the actual fuel element.

As described above, the uncovered portions may be formed in various ways. For instance, in one embodiment, the paint (i.e., treatment material) is allowed to dry on the untreated surface, and the paint is removed from the uncovered portions by abrasion. Alternatively, in another embodiment, the paint is not allowed to dry on the untreated surface. Instead, the paint is substantially removed from the uncovered portions by wiping the uncovered portions.

In another alternative method, the uncovered portions are masked before the paint is applied to the untreated surface. The mask is removed thereafter to expose the uncovered portions.

The simulated ember bed is made of any suitable material. However, it is preferred that the simulated ember bed is made of polypropylene. Also, although the simulated fuel element body may be made of any suitable material, it is preferred that the body is made of glass. Preferably, the body is a fragment of glass which is shaped so that its shape generally resembles the shape of an actual piece of coal.

In use, the bodies preferably are positioned with the base surfaces thereof facing downwardly (i.e., in the predetermined position) on a sheet, or a tray. The treatment material is then distributed over the untreated surfaces of the bodies. This could be done, for example, by spraying the treatment material, if it is amenable to spraying. Preferably, the treatment material is allowed to dry. After the treatment material has dried, then abrasion preferably is used to selectively remove the treatment material from those parts of the exposed surface which are intended to be the uncovered portions. Preferably, the uncovered portions are located substantially along preselected edges of the body, i.e., selected to provide a realistic simulation. The uncovered portions are located in this way because it provides a simulated coal element which is a realistic simulation of a burning (or at least partially burning) piece of coal, when light is transmitted through the body. Once the uncovered portions are defined, the covered portions are also defined, to provide the exposed surface 46.

As indicated above, another alternative method is to mask the light-transmitting portion(s) on the base surface. Any suitable mask material is used to mask the light-transmitting portion(s) of the base surface. For example, the mask material preferably is masking tape. In this method, the treatment material can be applied to the simulated fuel element bodies generally indiscriminately. For instance, it may be economic to apply the treatment material to the simulated fuel element bodies in a rotating drum, in which the treatment material and the masked simulated fuel element bodies are positioned. The treatment material (e.g., paint) is applied relatively evenly to the simulated fuel element bodies as the drum rotates. After the treatment material has dried, the mask material is removed, to uncover the light-transmitting portion(s) of the base surface. It is preferred that the uncovered portions are formed as follows. The treatment material preferably is selectively removed from those parts of the exposed surface of each simulated fuel element body which are intended to be the uncovered portions. This is done by any suitable method. In one embodiment, this is most effectively done manually, using sandpaper or any other suitable device to remove the treatment material after it has dried. As noted above, the last two steps of this process may be performed in any order, i.e., if desired, treatment material could be removed prior to removal of the mask material. Also as noted above, however, the uncovered portions may be defined using various methods.

The simulated ember bed is located in position substantially in front of the front surface of the screen of the flame simulating assembly. The simulated fuel elements preferably are positioned on the upper surface of the simulated ember bed, with base surfaces thereof facing downwardly and preferably engaging the upper surface. In one embodiment, the simulated fuel elements are positionable in predetermined positions on the upper surface. However, it is preferred that the upper surface is substantially planar, and also that the simulated fuel elements are positionable in a variety of positions on the upper surface, with base surfaces facing downwardly. Where the simulated fuel elements are positionable in a variety of positions relative to each other, the simulated fuel elements may be rearranged by the user from time to time to provide different arrangements.

Any element in a claim that does not explicitly state "means for" performing a specified function, or "step for" performing a specific function, is not to be interpreted as a "means" or "step" clause as specified in 35 U.S.C. §112, paragraph 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

I claim:

1. A flame simulating assembly for providing at least one image of flames and simulating at least one actual fuel element in a fire having at least one glowing portion and at least one dark portion, the flame simulating assembly comprising:

at least one light source;

a screen comprising a front surface, the screen being positioned in a first path of light from said at least one light source, the screen being adapted for transmission of said at least one image of flames therethrough;

a simulated fuel bed positioned at least partially in front of the front surface, the simulated fuel bed comprising:

a simulated ember bed comprising an upper surface, the simulated ember bed being positioned in a second path of light from said at least one light source and adapted for transmission of said light therethrough;

at least one simulated fuel element positioned on the upper surface of the simulated ember bed, said at least one simulated fuel element comprising:

a base surface positioned proximal to the upper surface, the base surface comprising at least one light-transmitting portion thereof through which said light from said at least one light source is transmittable; and an exposed surface which is at least partially viewable, the exposed surface comprising at least one uncovered portion through which said light from said at least one light source is transmittable, whereby said light from said at least one light source is transmittable through the simulated ember bed and through said at least one uncovered portion to simulate said at least one glowing portion of said at least one actual fuel element.

2. A flame simulating assembly according to claim 1 in which the base surface of said at least one simulated fuel element engages the upper surface of the simulated ember bed.

3. A flame simulating assembly according to claim 1 in which the upper surface of the simulated ember bed is substantially planar.

4. A flame simulating assembly according to claim 1 comprising a plurality of simulated fuel elements selectively positionable relative to each other on the upper surface in a plurality of positions.

5. A flame simulating assembly according to claim 1 in which the exposed surface comprises at least one covered portion for simulating said at least one dark portion of said at least one actual fuel element.

6. A simulated fuel element for simulating an actual fuel element in a fire having at least one glowing portion and at least one dark portion, the simulated fuel element comprising:

a light-transmitting body comprising a base surface and positionable in a predetermined position in which the base surface faces downwardly;

the body additionally comprising an exposed surface at least partially viewable when the body is positioned in the predetermined position;

the base surface comprising at least one light-transmitting portion through which light is transmittable into the body; and the exposed surface comprising at least one uncovered portion through which light transmitted through the body is transmittable to simulate said at least one glowing portion of the actual fuel element.

7. A simulated fuel element according to claim 6 in which the exposed surface additionally comprises at least one covered portion for simulating said at least one dark portion of the actual fuel element.

8. A simulated fuel element according to claim 6 in which said at least one dark portion is covered with a treatment material such that said at least one covered portion simulates said at least one dark portion of the actual fuel element.

9. A simulated fuel element according to claim 8 in which the treatment material is a dark paint providing a matte finish.

10. A simulated fuel element according to claim 8 in which the treatment material is a dark enamel paint.

11. A simulated fuel element according to claim 8 in which the treatment material is a dark polyester-based paint.

12. A simulated fuel element according to claim 6 in which the body comprises glass.

13. A method of forming a simulated fuel element for simulating an actual fuel element in a fire having at least one glowing portion and at least one dark portion, the method comprising:

(a) providing a light-transmitting body comprising a base surface on which the body is positionable when the body is disposed in a predetermined position, and an untreated surface which is substantially exposed when the body is in the predetermined position;

(b) at least partially covering the untreated surface with a treatment material; and (c) forming at least one uncovered portion to permit light to be transmitted through said at least one uncovered portion such that said at least one uncovered portion simulates said at least one glowing portion of the actual fuel element.

14. A method according to claim 13 in which step (c) at least partially defines at least one covered portion for simulating said at least one dark portion of the actual fuel element.

15. A method according to claim 13 in which said at least one uncovered portion is formed in step (c) by at least partial removal of the treatment material from said at least one uncovered portion.

16. A method of forming a simulated fuel element for simulating an actual fuel element in a fire having at least one glowing portion and at least one dark portion, the method comprising:

(a) providing a light-transmitting body comprising a base surface on which the body is positionable when the body is disposed in a predetermined position, and an untreated surface which is substantially exposed when the body is in the predetermined position;

(b) masking at least one light-transmitting portion of the base surface to substantially prevent a treatment material from contacting said at least one light-transmitting portion;

(c) at least partially covering the untreated surface with the treatment material; and (d) forming at least one uncovered portion to permit light to be transmitted through said at least one uncovered portion such that said at least one uncovered portion simulates said at least one glowing portion of the actual fuel element.

17. A method according to claim 16 in which step (d) at least partially defines at least one covered portion for simulating said at least one dark portion of the actual fuel element.

18. A method according to claim 16 in which said at least one uncovered portion is formed in step (d) by at least partial removal of the treatment material from said at least one uncovered portion.

19. A method according to claim 16 in which step (b) comprises masking said at least one light-transmitting portion with a mask material.

20. A method according to claim 19 additionally comprising:

(e) removing the mask material from said at least one light-transmitting portion, to uncover said at least one light-transmitting portion.

21. A method according to claim 16 in which the treatment material is a dark paint providing a matte finish.

22. A method according to claim 16 in which the treatment material is a dark enamel paint.

23. A method according to claim 16 in which the treatment material is a dark polyester-based paint.

24. A method according to claim 16 in which the treatment material is removed from said at least one uncovered portion by abrasion.

25. A simulated fuel bed for simulating an actual fuel bed including at least one actual fuel element having at least one glowing portion and at least one dark portion, the simulated fuel bed comprising:

at least one light source;

a simulated ember bed comprising an upper surface, the simulated ember bed being positioned in a path of light from said at least one light source and adapted for transmission of said light therethrough;

at least one simulated fuel element positioned on the upper surface of the simulated ember bed, said at least one simulated fuel element comprising:

a base surface positioned proximal to the upper surface, the base surface comprising at least one light-transmitting portion thereof through which said light from said at least one light source is transmittable; and an exposed surface which is at least partially viewable, the exposed surface comprising at least one uncovered portion through which said light from said at least one light source is transmittable, whereby said light from said at least one light source is transmittable through the simulated ember bed and through said at least one uncovered portion to simulate said at least one glowing portion of said at least one actual fuel element.

26. A simulated fuel bed according to claim 25 in which the exposed surface comprises at least one covered portion which is covered with the treatment material for simulating said at least one dark portion of said at least one actual fuel element.

* * * * *